United States Patent [19]

Lorenz et al.

[11] Patent Number: 4,792,382

[45] Date of Patent: Dec. 20, 1988

[54] PROCESS FOR REMOVING DUST FROM DRY COOLED COKE

[75] Inventors: Kurt Lorenz, Hattingen; Horst Dungs, Herne; Klaus Mrongowius, Recklinghausen; Jost-Wilfried Gehrhardt, Meerbusch, all of Fed. Rep. of Germany

[73] Assignee: Firma Carl Still GmbH & Ko. KG, Fed. Rep. of Germany

[21] Appl. No.: 936,183

[22] Filed: Dec. 1, 1986

Related U.S. Application Data

[63] Continuation-in-part of Ser. No. 763,448, Aug. 7, 1985, abandoned.

[30] Foreign Application Priority Data

Aug. 9, 1984 [DE] Fed. Rep. of Germany ..... 3429292
Feb. 8, 1986 [DE] Fed. Rep. of Germany ..... 3604061

[51] Int. Cl.[4] ..... C10B 39/02

[52] U.S. Cl. ..... 201/3; 201/39; 202/228

[58] Field of Search ..... 201/3, 39, 41, 4; 202/227, 228, 230, 263; 34/20, 57 C

[56] References Cited

U.S. PATENT DOCUMENTS 2,997,427 8/1961 Mansfield ..... 202/230
3,331,754 7/1967 Mansfield ..... 201/39
3,895,448 7/1975 Jonnet ..... 202/228
4,310,386 1/1982 Martens ..... 201/39
4,344,833 8/1982 Stratmann et al. ..... 201/41

FOREIGN PATENT DOCUMENTS 272378 7/1927 United Kingdom ..... 202/228

*Primary Examiner*—David L. Lacey
*Assistant Examiner*—Joye L. Woodard
*Attorney, Agent, or Firm*—McGlew and Tuttle

[57] ABSTRACT

The invention concerns a process for removing dust from coke cooled by a dry method after the coke has left the cooling zone of a cooling chamber, and a device for carrying out the process. A dust-free flushing gas is injected below the cooling zone, preferably parallel to the direction in which the coke moves when it has been cooled to below 200° C., to draw the gas off above the discharge lock together with the stirred-up coke dust, and to recirculate the gas after the dust is removed from it. As an alternative, compressed air is blown through the coke after it has left the lock and while it is being transported through a vibrating machine. The coke is cooled in a dry cooling unit to below 200° C. and preferably 130° to 180° C. The coke is then cooled outside the dry cooling unit by means of air at about 50° to 90° C. and preferably 70° to 80° C. Either simultaneously with or immediately after the cooling step with air, the coke is moistened, for example by sprinkling or spraying, to a residual moisture of 2% to 4% by weight and preferably 2% to 3% by weight.

5 Claims, 3 Drawing Sheets

PROCESS FOR REMOVING DUST FROM DRY COOLED COKE

CROSS-REFERENCE TO RELATED APPLICATION

The present application is a continuation in part of Ser. No. 763,448 filed Aug. 7, 1985, now abandoned.

FIELD AND BACKGROUND OF THE INVENTION

This invention relates in general to coking, and in particular to a process and device for removing dust from coke cooled by a dry process.

The invention concerns a process for removing dust from coke cooled by a dry method after the coke has left the cooling zone of a cooling chamber, and devices for carrying out the process. A process for cooling coke by a dry method is known, for example, from a publication in "Technische Mitteilung" No. 9, 1982, pages 434 to 439. The invention includes a cooling vessel having a cooling zone and below the cooling zone of a cooling chamber, there are so-called coke discharge rocking bars and, below the discharge rocking bars, the discharge shaft which is followed by a lock-type discharge device. The discharge device is also known, for example, from German disclosure document 30 14 574. According to illustration 1 in "Technische Mitteilungen" and the associated description, the two discharge locks lying side by side should be filled with an inert gas for safety reasons. The dust generated below the discharge locks and the subsequent coke transfer stations is continually drawn off and evacuated together with the dust-containing exhaust air generated intermittently at the coke intake.

It has been observed that after the coke has left the cooling zone of the cooling chamber and during the subsequent transport of the coke to the screening department and the shipping station, a number of emissions of fine dust occur. As a result of cooling the coke by a dry method, large volumes of fine coke particles are present on the surface of the coke, which are not, as in the case of wet quenching, absorbed by quenching water, but are dislodged in part only during the subsequent transport and the vibrations in the screening department.

SUMMARY OF THE INVENTION

The invention provides a process for removing dust and cleaning the fine coke dust from the surface of the coke without creating emissions.

In order to solve this problem it is proposed that, preferably parallel to the direction in which the coke moves when it has been cooled to below 200° C., dust-free flushing gas is injected below the cooling zone, drawn off above the discharge lock together with the stirred-up coke dust, and recirculated after the dust has been removed from it.

Through the process of the invention, all the coke dust originating below the cooling zone is removed by a simple method from the cooling chamber into a closed circuit. Precisely when the cooled coke falls from the discharge rocking bars onto the rotary table just above the discharge locks and then falls into one of the discharge locks, a great deal of fine coke dust is stirred up, which can be drawn off immediately by relatively small quantities of recirculating flushing gas.

It is advantageous to inject the flushing gas at the narrowest point of the funnel-shaped discharge opening so that a curtain of flushing gas is formed over the entire cross section.

According to the invention, the composition of the flushing gas may be the same as that of the cooling gas, or it may consist of another dry gas not containing any oxygen, in which case during start-up the cooling gas is used, by a simple method, as flushing gas. It is desirable to draw off the flushing gas before the coke enters the gas-tight discharge lock and, in order to remove the dust, is made to flow through cyclones and/or dry filters, such as, for example, hose filters. In order to prevent excessive temperatures, an additional heat exchanger for cooling purposes may be included in the flushing gas circuit, or small quantities of additional colder gas can be injected.

As an alternative proposal a process for removing dust from coke cooled by a dry method after the coke has left the cooling zone of a cooling chamber provides that compressed air is blown through the coke after discharge from the lock and during its subsequent transportation and that the compressed air charged with fine coke dust is drawn off through an exhaust dome and discharged into the open air after the dust has been removed from it. In this case the removal of the dust takes place immediately after the compressed air which is charged with dust, is drawn off.

This is advantageously effected in a dry-method dust removal facility, which is already present for other purposes. In order to prevent any emissions, the coke should be cleaned in a closed coke transportation room. It has been proved advantageous for this purpose if the coke cleaning station consists of an unbalanced vibrating machine mounted in a closed housing with a step-type conveying trough with openings for the passage of the air, in which case compressed-air inlets are located below and/or on the sides of the conveying trough and exhaust connections are located above the conveying trough. In a step-type conveying trough of this kind, the coke slides and drops over the individual steps of the trough and is shaken and turned over and over again in the process. In this design it is desirable to place the slits for the passage of the compressed air between the steps of the conveying trough, in order to make it possible to blow out the coke dust at the points at which the coke drops freely. The steps of the conveying trough may, according to the invention, also consist of a number of individual sheet metal pieces which are made to oscillate up and down at one end. This oscillating up-and-down motion can be achieved, for example, by unbalanced wheels turning on a horizontal shaft. According to the invention, the floor pieces of the conveying trough can also be designed as screens or sieves. In this connection it is useful to locate the floor of the unbalanced vibrating machine below the conveying trough, as a dust-collecting container which is connected to devices for expelling the dust. Finally, it has proved advantageous to provide compressed air inlets opening toward the ejection parabolas of the intake and transfer points of the unbalanced vibrating machine. Particularly at these points, the coke drops a considerable distance to the next transport device. For this purpose, it is desirable to place the exhaust connections directly above these additional compressed-air inlets.

In sum, a number of advantageous proposals have been made according to the invention to remove the major part of the fine coke dust from coke cooled by dry methods, either already in the cooling chamber, or, after it leaves the cooling chamber, during its subsequent transportation in closed systems. Both the recirculating flushing gas and the compressed air injected are at such a low temperature that no problems of any kind arise in the dust removal equipment downstream.

In accordance with the invention, dust is removed from coke after it is first cooled by a dry method in which the coke is moved through a cooling zone of a cooling chamber and it is moved downwardly out of the cooling chamber which comprises injecting a dust-free flushing gas into the coke as it is moved below the cooling zone preferably in a direction parallel to the direction in which the coke moves when it has been cooled to below 200° C., passing coke through a discharge lock, drawing the gas off the coke above the discharge lock together with dust which is stirred up from the coke through a discharge lock, drawing the gas off the coke above the discharge lock together with dust which is stirred up from the coke, and removing the dust from the drawn-off gas and recirculating drawn-off gas after the dust is removed. Another object of the invention is to provide a device which includes a vibrating machine forming a lock into which the coke is directed after it is cooled and which has a plurality of stepped areas onto which the coke is moved and advanced by the vibration of the stepped areas and which includes means for directing air through the coke between the steps and for drawing the air off separating the dust from the air and recirculating at least a portion of it.

It has been shown that by treating the coke with pressurized air in this way a substantial decrease in dust emissions during further transport of the coke to the blast furnace can indeed be achieved. A further object of this invention is thus to improve upon this dust removal process even further. For this purpose, the following process steps are suggested:

(a) Cooling the coke in the coke dry cooling unit to below 200° C., preferably 130° to 180° C.;
(b) Cooling the coke outside the coke dry cooling unit by means of air to about 50° to 90°, preferably 70° to 80° C.;
(c) Following or simulataneously with step (b), moistening the coke, e.g., by sprinkling or spraying, to a residual moisture of from 2% to 4%, preferably 2% to 3%, by weight.

Surprisingly, it has been shown that when cooled to a temperature of 50° to 90° C., preferably 70° to 80° C., and subjected to surface spraying, the coke has as low a water content as possible for use in the blast furnace, and it attains the residual moisture specified by the invention for binding the fine coke particles located in particular on the surface of the coke. The water sprayed on the surface binds this fine coke dust to the extent that even during further loading and conveyance to the blast furnace it does not come loose and result in emissions.

It has further been shown that following the cooling of the coke to below approximately 80° C. the water applied to the coke no longer evaporates and hence that sufficient moisture remains on the surface of the coke to bind and fix the fine dust. This effect can be reinforced by spraying the air with water so that it is heavily saturated with water vapor before it is blown through the coke. This also has the effect of cooling the coke. The water can be suitably applied by means of spray or atomizing nozzles mounted over a sieve-like conveyor belt. The precise does of water is given off so that it does not fall below the dew point, and the final temperature of the coke adjusted to at least 50° C., preferably around 80° C. The dust-laden exhaust air is suitably scrubbed by means of a filter and when cleaned is released into the atmosphere by means of a downstream suction exhaust fan that is driven by a steam turbine that utilizes steam from the coke dry cooling process.

It has been shown to be particularly advantageous pursuant to the invention to pass the coke through a sieve before or during the moistening process, and to seive out grains finer than 30 mm, preferably finer than 10 mm. This means that only the larger pieces of coke are moistened, and the fine dust adheres for the most part to such pieces.

In order to carry out the process pursuant to the invention, the coke is conveyed into an enclosed housing by means of a sieve-like conveyor belt with air feed devices and spray or atomizing nozzles above and air exhaust devices below the sieve-like belt. The treatment of the coke pursuant to the invention can be carried out in batches or continuously in the enclosed vessel. Particularly with batch processing, the process can be carried out without dust emissions and in particular under a higher air pressure. To remove the dust from the coke, the sieve-like conveyor belt is stopped and the entrance and exit sluices for the coke are closed for approximately 5 to 60, preferably 15 to 30 seconds. It is helpful in this regard to have the sieve-like conveyor belt located entirely within the enclosed housing, and the coke can be thrown onto this sieve-like conveyor belt by a conveyor belt located outside the housing and upon exiting can fall, via a chute for example, onto another conveyor device.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
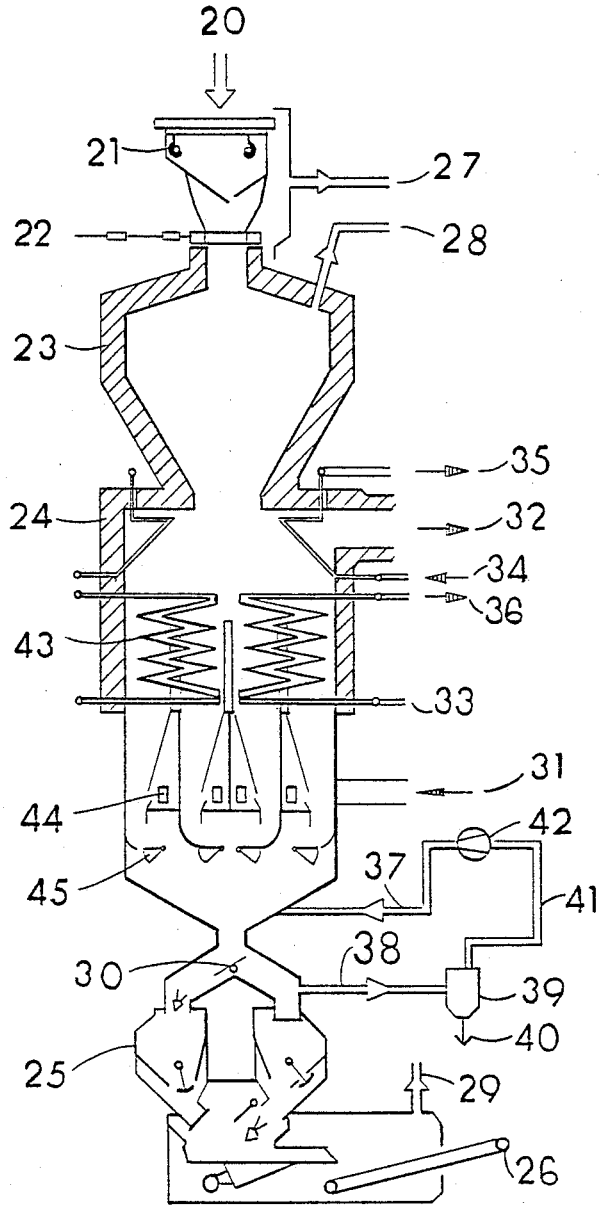
FIG. 1 is a longitudinal section through part of a coke dry-cooling system with a discharge device.

Referring to the drawings in particular, the invention embodied therein comprises a process and apparatus for removing dust from coke after it is first cooled by moving the coke in the path of the arrow 20 in FIG. 1 through a coke transporting bucket 21 through a lock slide 22 into an antechamber 23 of the coking vessel. Both the areas 21 and 22 and the antechamber 23 are connected through connecting lines 27 and 28 to a dust exhaust.

The coke passes through the antechamber 23 into a cooling chamber 24 which has a cooling wall 43. In addition feed water is supplied in the direction of the arrow 34 into the cooling chamber and exits as steam at 35. Feed water is also moved in a direction 33 through the cooling wall 43 and exits as steam in the direction 36.

The cooling vessel also includes a cooling gas channel 44 and a set of discharge rocking bars 45. Cooling gas is circulated in a direction of the arrow 31. Cool coke moves downwardly over a rotary table 30 and through discharge locks 25 in the form of a double lock system. Gas is moved out through an outlet 38 and circulated through a fine dust separator 39 and the separated dust is removed in the direction 40. A scavenging gas inlet is indicated at 37 for the return of gas from which the dust has been separated into a return line 41 feeding into the chamber by a blower 42. Gas is also circulated in the direction of the arrow 29 to the separator 39. Transfer conveyor 26 is provided for transferring the coke.

Figure 2:
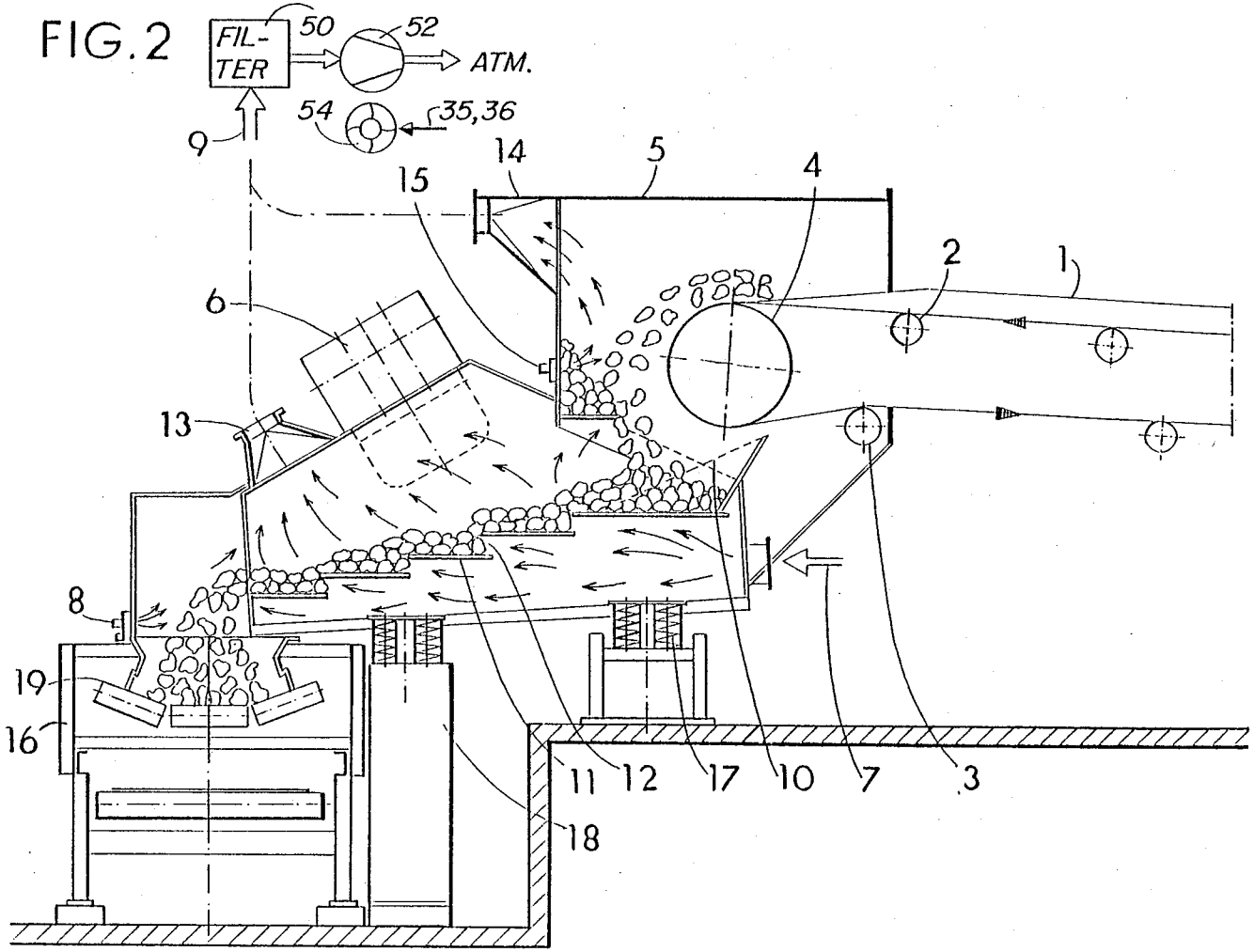
FIG. 2 is a section through an unbalanced vibrating machine with devices for the admission and discharge of compressed air.

As shown in FIG. 2, coke is moved on a coke conveyor which receives coke from conveyor 26 of FIG. 1, and which moves over reversing rolls 2, 3 and 4 where the coke is dumped into a vibrating machine 5 which has a gas outlet 14 at its upper end and has an air pressure unit 15 connected at its lower end which directs air at the coke which is collected therein. Coke is then discharged downwardly over step-like conveyor trough 11 and as the machine 5 is vibrated, pressurized air is directed into a chamber below the coke conveyor trough 11 in the direction of the arrow 7. The air flows between the step portions of the conveyor 11 through openings 12. A portion of it is exhausted through the exhaust line 13 which connects to an exhaust line for the dust 9. Vibrating machine 5 is mounted on supports 18 over spring 17 to permit its easy vibration. Compressed air is directed through an air inlet 8 at the discharge end of the step-like conveyor 11 and the coke is then moved on a conveyor 19 arranged in a conveyor housing 16.

FIG. 1 shows the coke dry-cooling facility with reference numerals 20 to 36 which refer to familiar items as noted above. The proposal of the present invention consists, in particular, of the recycling circuit 37 to 42, in which a dry and oxygen-free flushing gas is injected at the narrowest point of the cooling chamber discharge through line 37 into the cooling chamber, and is again drawn off just above the discharge lock chambers 25 through line 38. The space between the discharge rocking bars 45 and the rotary table 30 is partly filled with falling coke only when the discharge rocking bars are actuated and is filled with dust-charged gas during the times when the discharge rocking bars are inactive.

As a result of the fact that the recirculating cooling gas is injected, in accordance with the invention, at the narrowest possible point of the exit from the cooling chamber, a gas curtain is formed there, whose main purpose is to prevent gases charged with fine coke dust from rising into the space directly below the coke discharge rocking bars 45 from the filled lock chambers 25. Since the upper gates of the discharge lock chambers 25 are alternately opened and closed, the exit point 38 for the recirculating flushing gas can be located directly above these gates for both the discharge lock chambers shown. The flushing gas passes through fine-dust separators 39 of a familiar kind and flows through the line 41, the blower 42 and the line 37 back into the cooling chamber. The separated fine dust is transported through the dust discharge mechanism 40 to a central dust collecting tank.

After the cooled coke leaves the transfer point 26 shown in FIG. 1, it can be transported to the additional or alternative coke cleaning station shown in FIG. 2. In this case the coke is moved through the coke conveyor 1, which includes reversing rolls 2, 3 and 4, into the cleaning station. There it drops onto the step-type conveying trough 11 and, by the action of our unbalanced drive 6 of the unbalanced vibrating machine 5, is moved from step to step until it drops onto the coke transport belt 19 located in the belt housing 16. In order to ensure uniform distribution of the coke over the entire width of the conveying trough 11, a wedge-shaped spreader 10 is located at the upper end of the conveying trough 11. Below the conveying trough 11 is located the compressed air inlet 7, and below the individual steps of the conveying trough 11, the compressed air is injected through the openings or slits 12 into the coke pile and/or the coke dropping from the individual steps. Outlets 13 and 14 for the compressed air charged with dust are located above the coke pile. The dust-charged air is moved through the exhaust lines 9 to a dust-removal station of a familiar kind. Additional inlets 8 and 15, through which additional compressed air is injected into the path of the falling coke, are located at the transfer point from the coke conveyor 1 to the conveying trough 11 and also at the transfer point from the conveying trough 11 and also at the transfer point from the conveying trough 11 to the coke conveyor belt 19. The entire unbalanced machine 5 is located in a closed housing and supported on the legs 18 and springs 17.

According to other features of the invention shown in FIGS. 1 and 2, the coke is first cooled in the coke dry cooling unit of FIG. 1 to below 200° C. and preferably 130° to 180° C. This is a temperature at which coke leaves the cooling unit on conveyor 26.

The air cooling of FIG. 2 is achieved to about 50° C. to 90° C. and preferably from 70° C. to 80° C.

Simulataneously with or immediately after the cooling step shown in FIG. 2, the coke is moistened, e.g. by spraying or sprinkling with water to a residual moisture of from 2% to 4% by weight and preferably from 2% to 3% by weight.

In the embodiments shown in FIG. 2, this can be done by admixing water with the air supplied through inlets 8 and 15 which act as spray or atomizing nozzles. The air is heavily saturated with water vapor before it is blown through the coke at least to a level above the dewpoint.

According to another feature of the invention, the dust laden exhaust air at exhaust 9 is filtered through a filter 50 and then drawn off by an exhaust fan 52 through the atmosphere. Exhaust fan 52 produces a suction for drawing off the air through outlets 13 and 14.

According to another feature of the invention, steam from steam outlets 35 and 36 of FIG. 1 is used to power a steam turbine 54 which rotates the fan 52.

Figure 3:
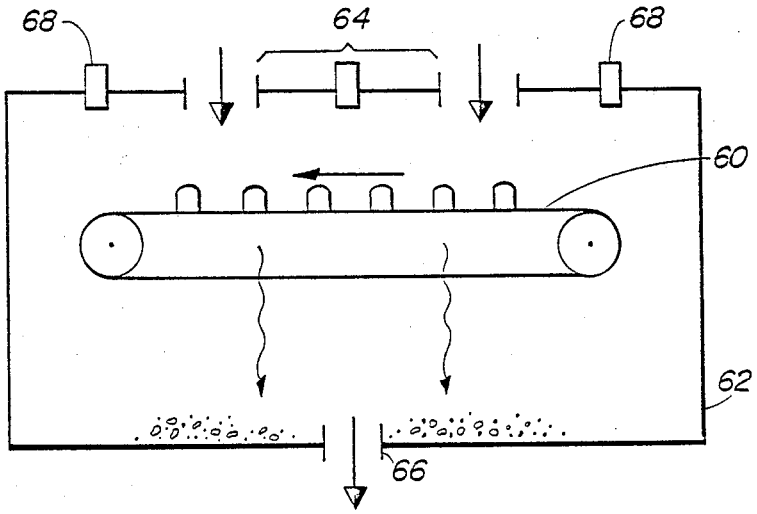
FIG. 3 is a section through a vibrating machine in another embodiment of the invention.

In the embodiment shown in FIG. 3, the coke is passed through a sieve 60 before or during the moistening step and a fraction smaller than 30 milimeters and preferably smaller than 10 milimeters is sieved off. The sieve 60 can be in the form of a sieve-like belt which is enclosed within housing 62. Air feed devices 64 above the sieve belt 60 supply pressurized air in a downward direction and the air is exhausted through outlets 66 below the belt. Spray or atomizing nozzles 68 are provided above the belt for spraying water onto the coke.

What is claimed is:

1. A process for removing dust from coke using a dust free flushing gas after it is first dry cooled to about 200° C. in a dry cooling zone of a cooling chamber, comprising removing the dry cooled coke from the dry cooling zone by directing the dry cooled coke through a brief free falling movement towards a discharge lock at a lower end of the cooling chamber while injecting the dust free flushing gas into the free falling coke in a direction which is parallel to the direction of movement of the free falling coke, drawing the flushing gas through the free falling coke above the discharge lock and entraining dust which is stirred up in the coke during the brief free falling movement, withdrawing the flushing gas and entrained dust from the cooling chamber above the discharge lock and separating the entrained dust from the flushing gas to form a dust free flushing gas once again and injecting said dust free flushing gas into the free falling coke as it is removed from the dry cooling zone of the cooling chamber.

2. A process according to claim 1, including discharging the dry cooled coke through the discharge lock into a vessel and further cooling the coke therein to a temperature from 50° to 90° C. by blowing air through the coke and spraying the coke with water to moisten the coke to a residual moisture from 2% to 4% by weight.

3. A process according to claim 2 wherein said coke discharged through the discharge lock into the vessel includes residual dust, and said air blown through the coke to further cool the coke in said vessel entrains said residual dust, and exhausting dust entrained air from the vessel, passing the exhausted dust entrained air through a filter to clean the air, passing the clean air through a downstream suction exhaust fan and thereafter to atmosphere.

4. A process according to claim 1, including discharging the dry cooled coke through the discharge lock into a vessel and further cooling and moistening the coke therein by directing air which is heavily saturated with water vapor through the coke.

5. A process according to claim 1, wherein the flushing gas which is withdrawn is passed through a cyclone and/or dry filter to separate the entrained dust from the flushing gas.

* * * * *